US007322319B2

(12) United States Patent
Esau et al.

(10) Patent No.: US 7,322,319 B2
(45) Date of Patent: Jan. 29, 2008

(54) FAN ASSEMBLY

(75) Inventors: Dierk Esau, Neulussheim (DE); Waldemar Stark, Frankenthal (DE); Gerald Werner, Edingen Neckarhausen (DE); Peter Back, St. Leon-Rot (DE)

(73) Assignee: Deere & Company, Moline, IL (US)

( * ) Notice: Subject to any disclaimer, the term of this patent is extended or adjusted under 35 U.S.C. 154(b) by 17 days.

(21) Appl. No.: 11/274,725

(22) Filed: Nov. 15, 2005

(65) Prior Publication Data

US 2006/0112909 A1 Jun. 1, 2006

(30) Foreign Application Priority Data

Nov. 26, 2004 (DE) ..... 10 2004 057 153

(51) Int. Cl.
*F01P 5/06* (2006.01)

(52) U.S. Cl. ..... 123/41.49; 123/41.65; 123/41.7; 165/51

(58) Field of Classification Search ..... 123/41.11, 123/41.49, 41.65, 41.7, 198 E, 195 C; 165/41, 165/51

See application file for complete search history.

(56) References Cited

U.S. PATENT DOCUMENTS

| | | | | |
|---|---|---|---|---|
| 3,794,001 A | | 2/1974 | Birch et al. | |
| 4,194,556 A | * | 3/1980 | Watanabe et al. | 165/51 |
| 4,514,140 A | * | 4/1985 | Knopf | 415/119 |
| 4,522,160 A | * | 6/1985 | Speers et al. | 123/41.49 |
| 5,183,382 A | * | 2/1993 | Carroll | 415/173.6 |
| 5,704,418 A | * | 1/1998 | Baader et al. | 165/121 |

FOREIGN PATENT DOCUMENTS

| | | | |
|---|---|---|---|
| DE | 31 29 236 | | 8/1982 |
| DE | 40 15 259 | | 11/1991 |
| DE | 40 15 259 | A1 * | 11/1991 |
| DE | 41 17 336 | | 12/1992 |
| DE | 42 44 039 | | 12/1992 |
| EP | 0515785 | | 12/1992 |
| JP | 4-357328 | * | 12/1992 |
| JP | 8-4529 | * | 1/1996 |
| JP | 09088604 | | 3/1997 |
| JP | 09-2 64 138 | | 9/1997 |
| JP | 2002-122023 | A * | 4/2002 |
| WO | WO 98/37319 | | 2/1998 |

* cited by examiner

*Primary Examiner*—Stephen K. Cronin
*Assistant Examiner*—Ka Chun Leung

(57) ABSTRACT

A fan assembly for an agricultural tractor includes a rotatable fan mechanically driven by a drive shaft coupled to an internal combustion engine. A fan shroud encloses the outer periphery of the fan and is mechanically connected to the engine. A bearing is mounted on the drive shaft and supports the fan shroud so that the drive shaft is rotatable with respect to the fan shroud. The bearing prevents radial and axial movement of the fan shroud relative to the drive shaft. A fan housing is connected to a radiator which is connected to the engine. The fan housing is coupled to an end of the fan shroud by a friction coupler which prevents rotation of the fan shroud.

3 Claims, 2 Drawing Sheets

FAN ASSEMBLY

BACKGROUND

The present invention relates to a fan assembly for an internal combustion engine.

WO 98/037319 A shows a fan assembly for a vehicle engine. The circumference of a fan driven by the vehicle engine is enclosed by a fan shroud that is fastened to the vehicle engine by several retainers. A fan housing is arranged between a radiator and the fan shroud and is rigidly connected to the radiator. A slot is located between the fan housing and the radiator and is closed by a seal of an elastic material such as rubber, in order to maintain the sealing function when the engine and the radiator slide relative to each other during the operation of the vehicle. Here the fan shroud is immobilized by the retainer on the engine so that a certain cost is incurred for the manufacture and the attachment of the retainer arrangement.

U.S. Pat. No. 3,794,001 A describes another fan assembly with a fan driven by the engine. The radiator carries a fan housing with a ring-shaped projection into which a fan shroud that is adjacent to the circumference of the fan is inserted. Here relative movements between the fan shroud and the fan are possible that require a relatively large slot between these elements which has a detrimental effect on the efficiency of the fan.

Moreover fan assemblies are known in which the fan shroud is rigidly fastened to the radiator and carries the electrically driven fan motor and the fan. (DE 42 44 039 A). These arrangements are particularly appropriate for lower cooling capacities, since the electric drive of the fan requires a high cost and is subjected to high losses.

SUMMARY

Accordingly, an object of this invention is to provide a fan assembly which can be manufactured simply and cost effectively.

This and other objects are achieved by the present invention, wherein a fan shroud is rotatably supported by a bearing with respect to a fan drive shaft which is driven mechanically by the engine. Thus, other devices for mounting the fan shroud to the engine are not required. Moreover, the fan can be positioned close to the fan shroud, since the fan shroud cannot move relative to the fan and even during vibrations of the engine.

While the bearing supports the fan shroud and prevents axial and radial movement of the fan shroud relative to the drive shaft. The fan shroud is immobilized in the circumferential direction by a fan housing indirectly connected to the engine. The fan shroud is held in contact with the fan housing under a preload. The resulting friction connection prevents rotation of the fan shroud. Preferrably, the fan housing is attached to a radiator through which the fan blows air. The fan shroud could also be connected to the engine or another element in order to prevent rotation of the fan shroud. The fan shroud could be provided with a projecting dog which engages an opening in the frame of the vehicle.

Relative movements between the fan shroud and the fan housing are preferably absorbed by appropriate, flexible uncoupling elements that are arranged between the fan shroud and the fan housing.

The fan shroud may be a one-piece, rotationally symmetrical element and hence a cost effective unit, since no additional steps are required for its mounting.

With this fan assembly, it is possible to manufacture a component group composed of the drive shaft, the fan and the fan shroud connected by the bearing arrangement with the drive shaft. This group of components is then inserted into an intermediate space between a radiator with a fan housing and an engine, so that rotation of the fan shroud is prevented by the contact with the fan housing. The drive shaft is connected to the engine.

DETAILED DESCRIPTION

Figure 1:
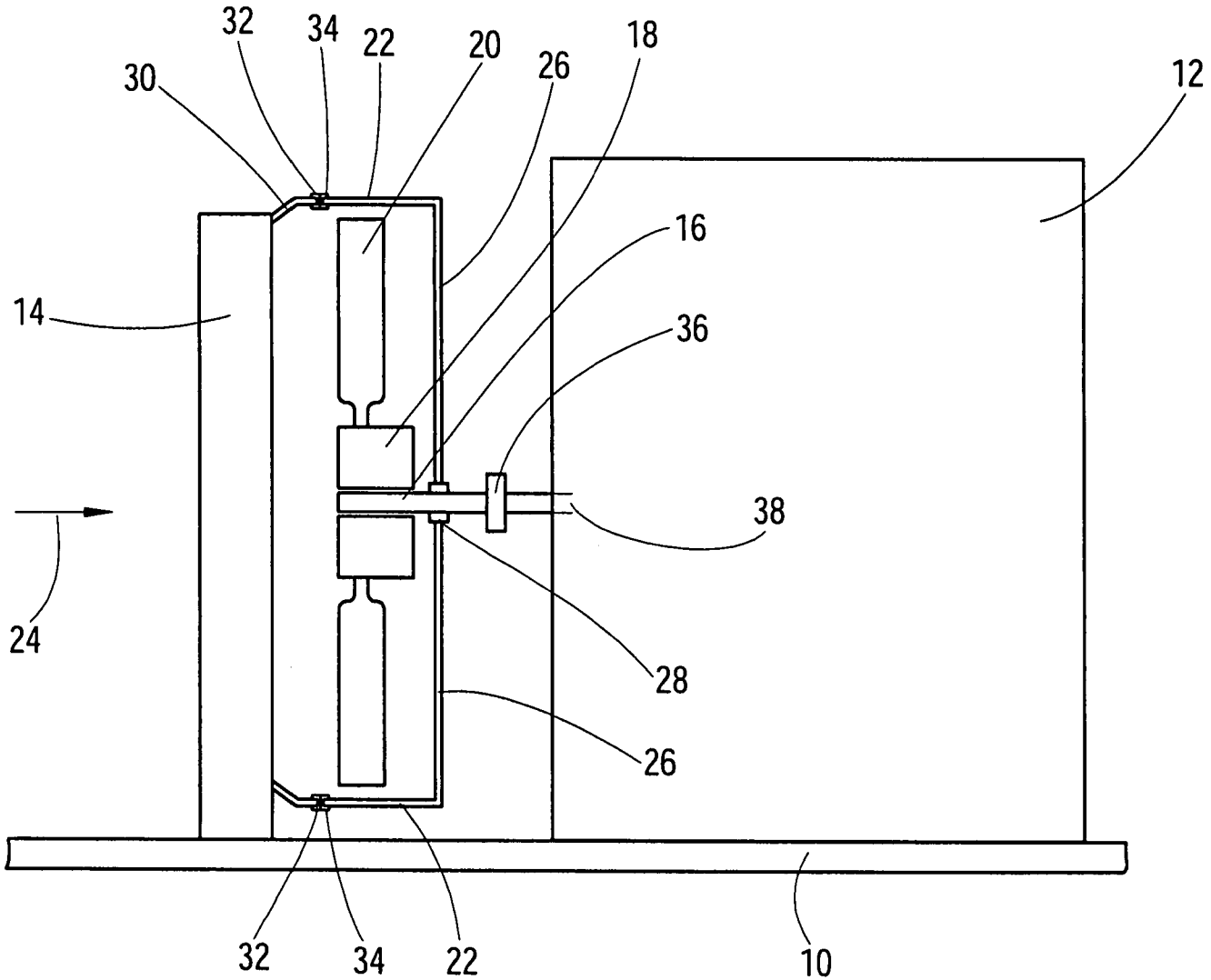
FIG. 1 is a schematic sectional side view through a fan assembly according to the invention.
Figure 2:
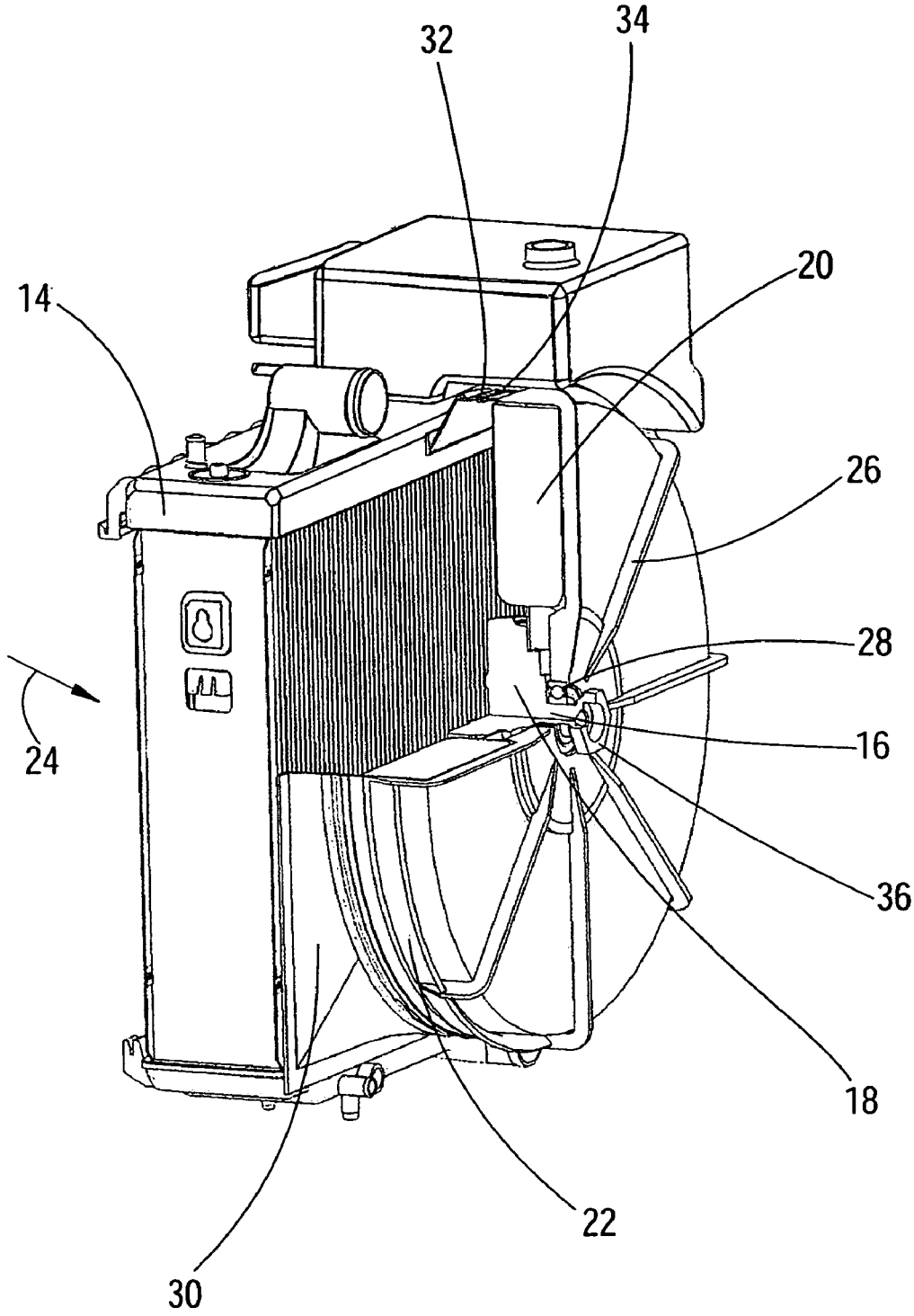
FIG. 2 is a perspective view of the fan assembly of FIG. 1.

Referring to FIG. 1, an internal combustion engine 12 is fastened to a frame 10 of a vehicle, in particular an agricultural vehicle, for example, a tractor, a telescopic loader or a self-propelled harvesting machine. The engine is fastened, preferably by means of rubber bearings (not shown). The frame also carries a radiator 14 for cooling the engine 12 and/or other components of the vehicle. The radiator 14 can use oil or water as coolant. In place of the radiator 14 a charge air cooler for a turbo-charger of the engine 12 or a cooling arrangement for an air conditioning system or a cooler for a hydraulic circuit of the vehicle or the like could be provided, in place of the radiator or downstream or upstream or to the side or vertically alongside or above the radiator 14.

The engine 12 has an output shaft 38 which extends towards the radiator 14. A clamping nut 36 connects the input shaft 16 to the output shaft 38 of the engine 12. The output shaft 38 drives various driven vehicle components, such as a power take off shaft (not shown) or harvested crop processing systems not shown). A shiftable clutch 18 is mounted on the input shaft 16, and the clutch 18 is surrounded by a fan 20 with blades for blowing air. The clutch 18 may be actuated electrically, hydraulically or thermally and engages or disengages step-wise or continuously. When the engine 12 is running and the clutch 18 is engaged, the fan 20 blows air in the direction of the arrow 24 through the radiator 14 and to the engine 12.

The outer circumference of the fan 20 is surrounded by a fan shroud 22. The fan shroud 22 forms a closed ring around the fan 20 and includes struts 26 at its end facing the engine 12. The struts 26 project radially away from the drive shaft 16. The spaces between the struts 26 can be empty or free, or a screen can be arranged in these spaces.

The struts 26 are supported by a bearing 28 such as a rolling contact bearing (for example, a needle bearing or a ball bearing) on the drive shaft 16. The bearing 28 prevents radial and axial movement of the fan shroud 22 relative to the drive shaft 16. The fan shroud 22 is preferably made of plastic. Since the fan shroud 22 is supported by bearings on the drive shaft 16, and the shaft 16 also carries the fan 22, no relative movement can occur between the fan 20 and the fan shroud 22. The fan shroud 22 is a one-piece component, and is rotationally symmetrical and therefore can be manufactured with tight tolerances. The radial space or separation between the fan 20 and the fan shroud 22 can made narrow. This results in a fan having a high efficiency and a low noise level.

A fan housing 30 is fastened on the side of the radiator 14 facing the fan 20. The housing 30 includes a funnel-shaped portion which covers the surfaces of the radiator 14 located outside of the enveloping circle of the fan 20. The housing 30 also includes a ring portion which is coupled to fan shroud 22 by couplers 32 and 34.

Coupler 32 has a U-shaped cross section, is attached to the end face of the fan housing 30, and is made of elastic material (preferably rubber) that is forced onto and encloses an edge of the fan housing 30. Identical coupler 34 is fastened to the adjoining end face of the fan shroud 22.

The couplers 32, 34 are in contact with each other under a preload. Since the fan shroud 22 transmits a force to the fan housing 30, the couplers 32, 34 are compressed to a certain degree. Thereby, the fan shroud 22 is immobilized in the direction of rotation of the fan 20. The sealing effect of the couplers 32, 34 remains effective because of their flexibility, even when the radiator 14 and the fan housing 30 moves relative to the engine 12 and the fan shroud 22 connected to it.

A group of components consisting of the clutch 18, the fan 20 and the fan shroud 22 can be pre-assembled and then installed in the vehicle as a complete unit. No additional retainers or the like are required to fasten the fan shroud 22 to the engine 12 or to the fan housing 30. The fan assembling can be assembled by:

1) mounting the fan 20, shroud 22 and the bearing 28 on the drive shaft so that the bearing prevents axial and radial movement of the fan shroud relative to the drive shaft 16;

2) inserting the fan 20, fan shroud 22 and drive shaft into a space between the engine 12 and the fan housing 30;

3) engaging an end of the fan shroud 22 with the fan housing 30; and 4) connecting the drive shaft 16 to the engine 12.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

ASSIGNMENT

The entire right, title and interest in and to this application and all subject matter disclosed and/or claimed therein, including any and all divisions, continuations, reissues, etc., thereof are, effective as of the date of execution of this application, assigned, transferred, sold and set over by the applicant(s) named herein to Deere & Company, a Delaware corporation having offices at Moline, Ill. 61265, U.S.A., together with all rights to file, and to claim priorities in connection with, corresponding patent applications in any and all foreign countries in the name of Deere & Company or otherwise.

We claim:

1. A fan assembly having a fan rotatably mechanically coupled to an internal combustion engine by a drive shaft, and a fan shroud enclosing the fan in the circumferential direction and mechanically connected to the engine, characterized by:

a bearing mounted on the drive shaft and supporting the fan shroud so that the drive shaft is rotatable with respect to the fan shroud, the bearing preventing axial and radial movement of the fan shroud relative to the drive shaft;

a fan housing connected indirectly to the engine;

a first flexible friction coupler mounted to the fan shroud; and a second flexible friction coupler mounted to the fan housing, the friction couplers being held in contact with each other under a preload so that friction between the friction couplers prevents rotation of the fan shroud without additional retainers.

2. The fan assembly of claim 1, wherein:

the fan shroud is supported only by the bearing and the fan housing via the friction couplers.

3. The fan assembly of claim 1, wherein:

the fan housing is connected to a radiator which is connected to the engine.

* * * * *